US006048418A

United States Patent [19]

Canner

[11] Patent Number: 6,048,418

[45] Date of Patent: Apr. 11, 2000

[54] RING FORMING APPARATUS AND HEAT TREATING PROCESS

[75] Inventor: Herman M. Canner, Bloomfield Hills, Mich.

[73] Assignee: Sterling Detroit Company, Royal Oak, Mich.

[21] Appl. No.: 09/098,105

[22] Filed: Jun. 16, 1998

[51] Int. Cl.[7] ..... C21D 8/00

[52] U.S. Cl. ..... 148/589; 148/647; 266/117

[58] Field of Search ..... 148/589, 647; 266/117

[56] References Cited

U.S. PATENT DOCUMENTS

| | | | |
|---|---|---|---|
| 1,457,772 | 6/1923 | Forsyth | 148/647 |
| 3,506,501 | 4/1970 | Hays et al. | 148/647 |

FOREIGN PATENT DOCUMENTS

| | | | |
|---|---|---|---|
| 123179 | 4/1959 | Russian Federation | 148/589 |

*Primary Examiner*—Deborah Yee
*Attorney, Agent, or Firm*—Reising, Ethington, Barnes, Kisselle, Learman & McCulloch, P.C.

[57] ABSTRACT

An improved method for heat treating and forming Belleville washers, springs, clutch plates and the like by initially stamping or otherwise forming a flat ring, heating the ring to an elevated temperature of approximately 1700° F., placing the hot ring within a die at least partially submerged in a molten salt bath and forming the ring into its final, generally frustoconical or tapered configuration while submerged in the molten salt bath. The heated formed ring is maintained in the closed die for approximately 30 seconds and is thereafter released from the die and maintained within the molten salt bath, which is maintained at a temperature of approximately 600° F., for approximately one-half hour to further heat treat or austemper it to achieve the desired metallurgical properties of the steel part. By forming the hot ring within the forming dies immersed in the molten salt bath, the deformation caused by forming and the initial rapid cooling of the heated part in the cooler salt bath is minimized, if not eliminated completely. After a short duration of approximately 20 to 30 seconds, the part is sufficiently cooled so that it may be released from the die and maintained in the molten salt bath without significant deformation upon further heat treating and subsequent cooling. Maintaining the formed part within the molten salt bath for approximately one-half hour further heat treats the steel to provide the desired metallurgical properties of the finished part. Specifically, a significant amount of bainite is formed which provides a high hardness, ductility and impact resistance and permits significant flexing of the part without failure.

17 Claims, 5 Drawing Sheets

RING FORMING APPARATUS AND HEAT TREATING PROCESS

FIELD OF THE INVENTION

This invention relates generally to forming metal parts and more particularly to an improved method and apparatus for forming and heat treating resilient, metal rings such as clutch plates, Belleville washers, springs and the like.

BACKGROUND OF THE INVENTION

Clutch plates such as those used in automatic transmissions and Belleville springs or washers are well known. Belleville springs and the like, and at least some clutch plates are annular rings with a tapered or generally frustoconical shape. These parts have been formed by stamping or otherwise forming a flat, annular disk of spring steel into its final, tapered or frustoconical shape, heating the stamped part to an elevated temperature typically between about 1550° F. to 1600° F. and then subsequently immersing it into a quenching medium such as a molten salt bath at about 600° F. to heat treat the part. The part is unrestrained during the heating and quenching and becomes warped during the heat treating process. Subsequently the warped part must be reformed into the desired shape by clamping typically on a mandrel while being tempered to stress relieve and improve the metallurgical properties of the steel. The added steps to reform the part after the heating and quenching process is undesirable, time consuming and costly but necessary due to the deformation of the part which occurs upon heating and quenching.

SUMMARY OF THE INVENTION

An improved method for heat treating and forming Belleville washers, springs, clutch plates and the like by initially stamping or otherwise forming a flat ring, heating the ring to an elevated temperature of approximately 1700° F., placing the hot ring within a die at least partially submerged in a molten salt bath and forming the ring into its final, generally frustoconical or tapered configuration while submerged in the molten salt bath. The heated formed ring is maintained in the closed die for approximately 30 seconds and is thereafter released from the die and maintained within the molten salt bath, which is maintained at a temperature of approximately 600° F., for approximately one-half hour to further heat treat or austemper it to achieve the desired metallurgical properties of the steel part. By forming the hot ring within the forming dies immersed in the molten salt bath, the deformation caused by the initial rapid cooling of the heated part in the cooler salt bath is minimized, if not eliminated completely. After a short duration of approximately 20 to 30 seconds, the part is sufficiently cooled that it may be released from the die and maintained in the molten salt bath without significant deformation upon further heat treating and subsequent cooling. Maintaining the formed part within the molten salt bath for approximately one-half hour further heat treats the steel to provide the desired metallurgical properties of the part. Specifically, a significant amount of bainite is formed which provides a high hardness, ductility and impact resistance and permits significant flexing of the part without failure.

Objects, features and advantages of this invention include providing an improved method of forming and heat treating metal rings which reduces or eliminates deformation of the rings upon heating and subsequent quenching, does not require an additional forming step to reform warped or deformed rings, permits tempering of the formed rings within the same bath and without having to remove them from the bath in which they are quenched, provides a high rate of production, can be substantially automated and is rapid, economical and efficient.

BRIEF DESCRIPTION OF THE DRAWINGS

These and other objects, features and advantages of this invention will be apparent from the following detailed description of the preferred embodiment and best mode, appended claims and accompanying drawings in which:

DETAILED DESCRIPTION OF THE PREFERRED EMBODIMENTS

Figure 1:
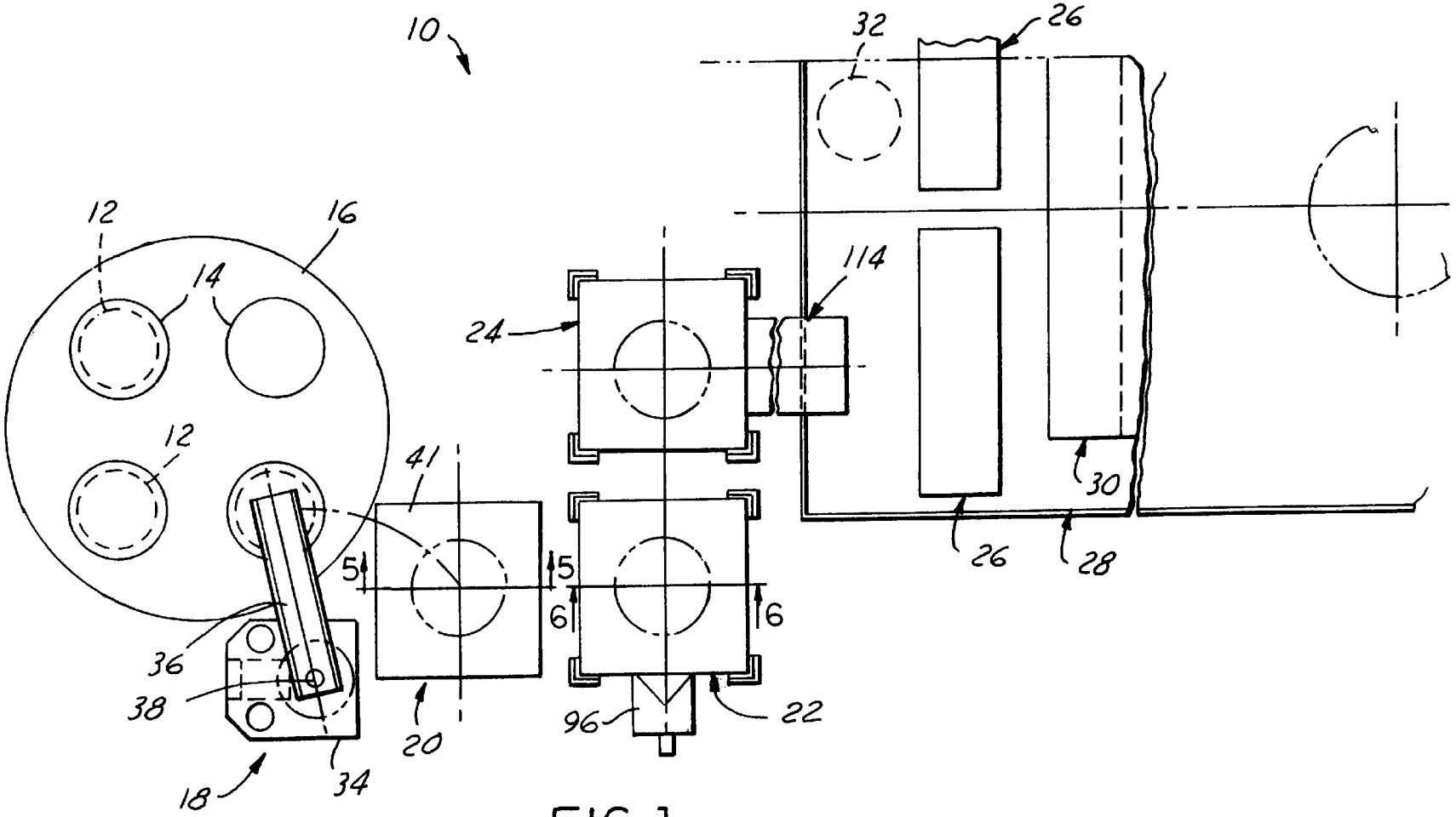
FIG. 1 is a semi-diagrammatic view illustrating a substantially automated system and apparatus embodying and carrying out the process of the present invention.
Figure 2:
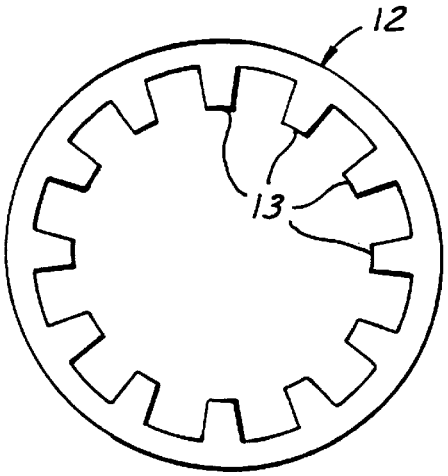
FIG. 2 is a plan view of a flat ring from which a clutch plate is made by the system and apparatus of FIG. 1.
Figure 3:
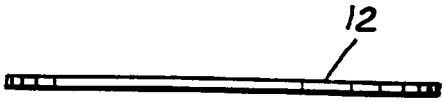
FIG. 3 is a side view of the flat ring of FIG. 2.
Figure 4:
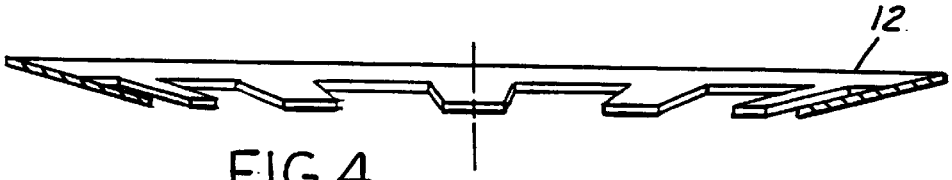
FIG. 4 is an enlarged sectional view of a clutch plate made by the system and apparatus of FIG. 1.

Referring in more detail to the drawings, FIG. 1 illustrates a system and apparatus 10 for forming and heat treating metallic rings 12, Belleville washers, springs and the like in accordance with the method of this invention. The system, apparatus and method are illustrated and described for forming and heat treating clutch plates of spring steel for automatic transmissions. As shown in FIGS. 2 and 3, completed clutch plates are made from a circumferentially continuous and flat or planar ring 12 which typically has a plurality of radially inwardly extending and circumferentially spaced integral teeth 13. Preferably, the flat ring 12 is formed by stamping it out of a flat plate, disk or strip of spring steel such as SAE 1070 spring steel with a nominal thickness of about 0.040 to 0.060 of an inch. As shown in FIG. 4, the completely formed and heat treated clutch plate 12 has a frustoconical shape and typically has an outside diameter of about 5 to 6 inches and the free ends of the teeth have an inside diameter of about 3½to 4½inches.

As shown in FIG. 1, in the system 10 individual flat rings 12 are received on spaced apart plates 14 of an indexing table 16 which rotates to align successive plates 14 with a pick and place mechanism 18. The pick and place mechanism 18 removes a ring 12 from a plate 14 and transfers it onto a preheating platen 20 to preheat the ring 12. From the preheating platen 20, the ring 12 is transferred to a first heater 22 and then into a second heater 24 for heating to its final temperature (usually about 1,450° to 1,700° F.). The heated ring 12 is then transferred into an open forming die 26 at least partially submerged in a molten salt bath 28 which closes to form the ring 12 into its final frustoconical shape while the ring is immersed in the molten salt bath 28. The ring 12 is restrained within the closed forming die 26 for a short period of time, usually on the order of 20 to 40 seconds, to prevent deformation of the formed ring as it is rapidly cooled in the salt bath 28. The die 26 is then opened and the formed ring is removed from the die 26 and maintained in the molten salt bath 28 for an extended period of time, typically about 25 to 35 minutes, to transform the austenite to bainite. When the formed ring is released, it is preferably carried away from the die by a conveyor 30 immersed in the molten salt bath 28. Preferably, more than one die 26 is disposed in the molten salt bath 28 so that more than one ring 12 may be formed and heat treated generally simultaneously.

Preferably, a pump 32 recirculates the molten salt bath 28 to maintain a substantially constant uniform temperature within the bath and to promote a more rapid and uniform transfer of heat from the rings to the molten salt which is believed to provide more consistent and uniform heat treatment throughout a production run forming a large number of completed clutch plates 12. Metallurgically, this heat treatment results in austempering of the formed steel ring without distortion thereof in which the heated steel is rapidly cooled from the austentizing temperature to the temperature of the molten salt bath 28 fast enough so that substantially no transformation of austenite occurs during this cooling and is then held at the bath temperature long enough to insure transformation of the austenite to bainite.

Indexing Table and Pick and Place Mechanism

As shown in FIG. 1, the indexing table 16 has a plurality of stations 14 each of which contains a stack of rings 12 and which are rotatably successively aligned with the pick and place mechanism 18. The pick and place mechanism 18 has a base 34 housing a motor which drives an arm 36 fixed to a shaft 38 coupled to the motor to rotate about the shaft 38 to transfer a ring 12 from a plate 14 of the indexing table 16 to the preheating platen 20. Preferably, the arm 36 has a vacuum pickup preferably in the form of an annular sealing ring which engages the ring 12 on the plate 14 of the indexing table 16 and through which a vacuum is applied to the ring 12 to remove the ring 12 from the plate 14 and hold the ring on the arm 36 as the arm 36 rotates. When the arm 36 is rotated above the preheating platen 20, the vacuum is relieved and the ring 12 drops onto the platen 20. Other conventional methods of transferring individual rings 12 to the preheating platen 20 or directly into the first heater 22, if no preheating platen 20 is used, may be utilized.

Preheating Platen

Figure 5:
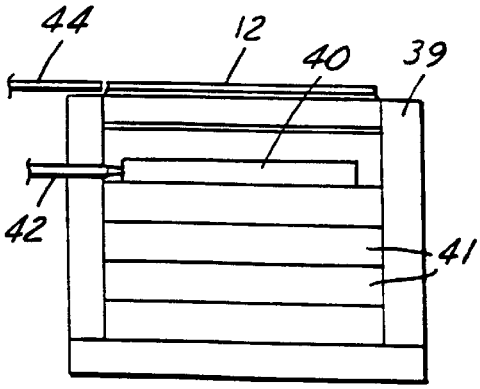
FIG. 5 is an enlarged cross sectional view of a preheating platen taken along line 5—5 of FIG. 1.

Preferably, to preheat the rings 12 before they are transferred to the first heater 22, the apparatus 10 has a preheating platen 20 which initially heats the rings 12 to reduce the amount of time needed to raise the rings 12 to their final temperature in the heaters 22, 24 and thereby increase the rate of production of the system and apparatus. As shown in FIG. 5, the preheating platen 20 preferably has a frame 39 which carries a ceramic body 40 in which is received one or more coiled wires 42 through which electrical current is passed to generate heat which is transferred to the rings 12 through the ceramic body 40 and a plate 41 between the body 40 and a ring 12 by conduction and radiant energy heating. Relatively rigid thermal insulating boards 41 may be disposed between the ceramic body 40 and the frame 39. The preheating platen 20 preferably has a pusher or other transfer mechanism 44 to transfer a ring 12 from the preheating platen 20 into the first heater 22.

First Heater

To increase the rate of production of formed rings 12, the system and apparatus preferably utilize first and second heaters 22, 24 due to the increased length of time required to heat each ring 12 to its final temperature compared to the relatively short length of time required to form and hold the ring 12 in the forming die 26.

Figure 6:
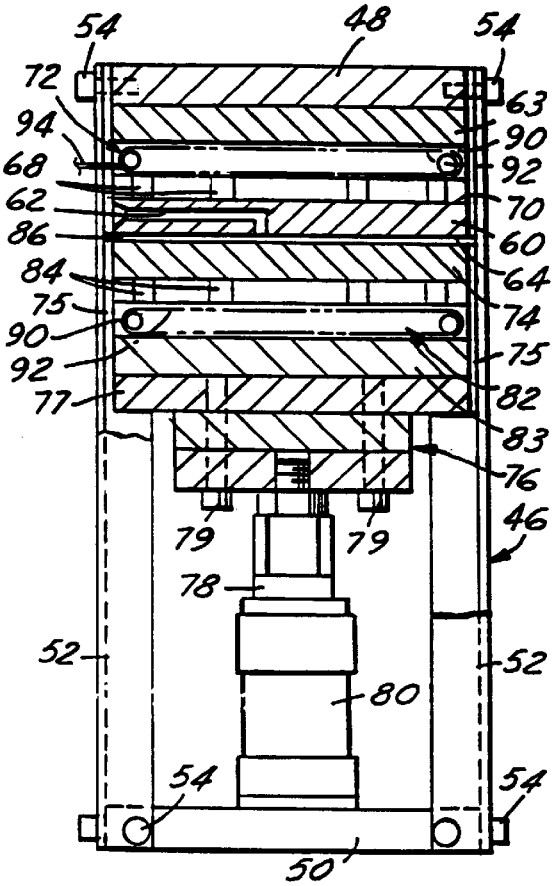
FIG. 6 is a cross sectional view of a first heater taken generally along line 6—6 of FIG. 1.

As shown in more detail in FIG. 6, the first heater 22 has an outer frame 46 with a top plate 48, bottom plate 50 and four side plates 52 of steel secured together by various bolts 54. The first heater 22 has an upper platen 60 fixed to the frame 46 and having a passage 62 formed therein and through which an inert gas is discharged into the heater and around the ring 12 to reduce oxidation of the rings 12 as they are heated. The lower face 64 of the upper platen 60 is preferably coated with a thin layer of an alloy, such as a cobalt-chrome-moly-silicon, to prevent wear of the upper platen 60, which is preferably formed of copper, by the flat rings 12 received in the heater 22. The copper plate upper platen 60 has high thermal conductivity to efficiently transfer heat to the ring 12 and is approximately 1 inch thick and the finished alloy coating is generally about 0.004 to 0.006 inches thick. One or more ceramic spacers 68 are disposed between an upper face 70 of the upper platen 60 and a heater element 72 separated from the top plate 48 by relatively rigid thermal insulating boards 63.

The first heater also has a lower platen 74 fixed to a carrier plate 75 which in turn is fixed to a bolster plate 77 fixed to a ram 76 by bolts 79. The ram 76 is connected to a cylinder rod 78 of a cylinder 80 the piston of which is driven to reciprocate between retracted and extended positions by a hydraulic or pneumatic power source. Reciprocation of the rod 78 moves the ram 76 to an open position, to permit a flat ring 12 to be inserted or removed from between the upper and lower platens 60, 74, and to a closed position clamping or holding a flat ring 12 between and bearing on the upper and lower platens 60, 74, respectively, as it is heated. A lower heater element 82 and one or more thermal insulating boards 83 are carried between the bolster plate 77 and ceramic spacers 84 disposed between the heater element and the lower platen 74. The lower platen 74 is preferably a copper plate with its upper face 86 coated with an alloy as described above with regard to the upper platen 60.

Each heater element 72, 82 comprises a ceramic plate or body 90 having one or more blind bores 92 with each bore 92 having a helical groove (not shown) formed therein and constructed to receive a spiral or coil of an electric heater wire 94 received through a hole in the frame 46 and connected to an electrical source which supplies current to the wire 94 to generate heat. The heated wire 94 heats the ceramic body 90 to heat the adjacent upper or lower copper platen 60 or 74, respectively. The first heater 22 is constructed to receive an individual flat ring 12 to raise the temperature of the ring 12 towards or to its final temperature, which is typically between about 1500° F. to 1700° F. When the second heater 24 is empty, the ram 76 of the first heater is retracted and the ring 12 therein is removed and transferred from the first heater 22 to the second heater 24 such as by a pusher arm 96 (FIG. 1) for final heating and subsequent transfer into the forming die 26.

Second Heater

The second heater 24 is constructed in substantially the same way as the first heater 22. The parts of the second heater 24 which are the same as the first heater 22 will be given the same reference numbers and will not be described further.

Figure 7:
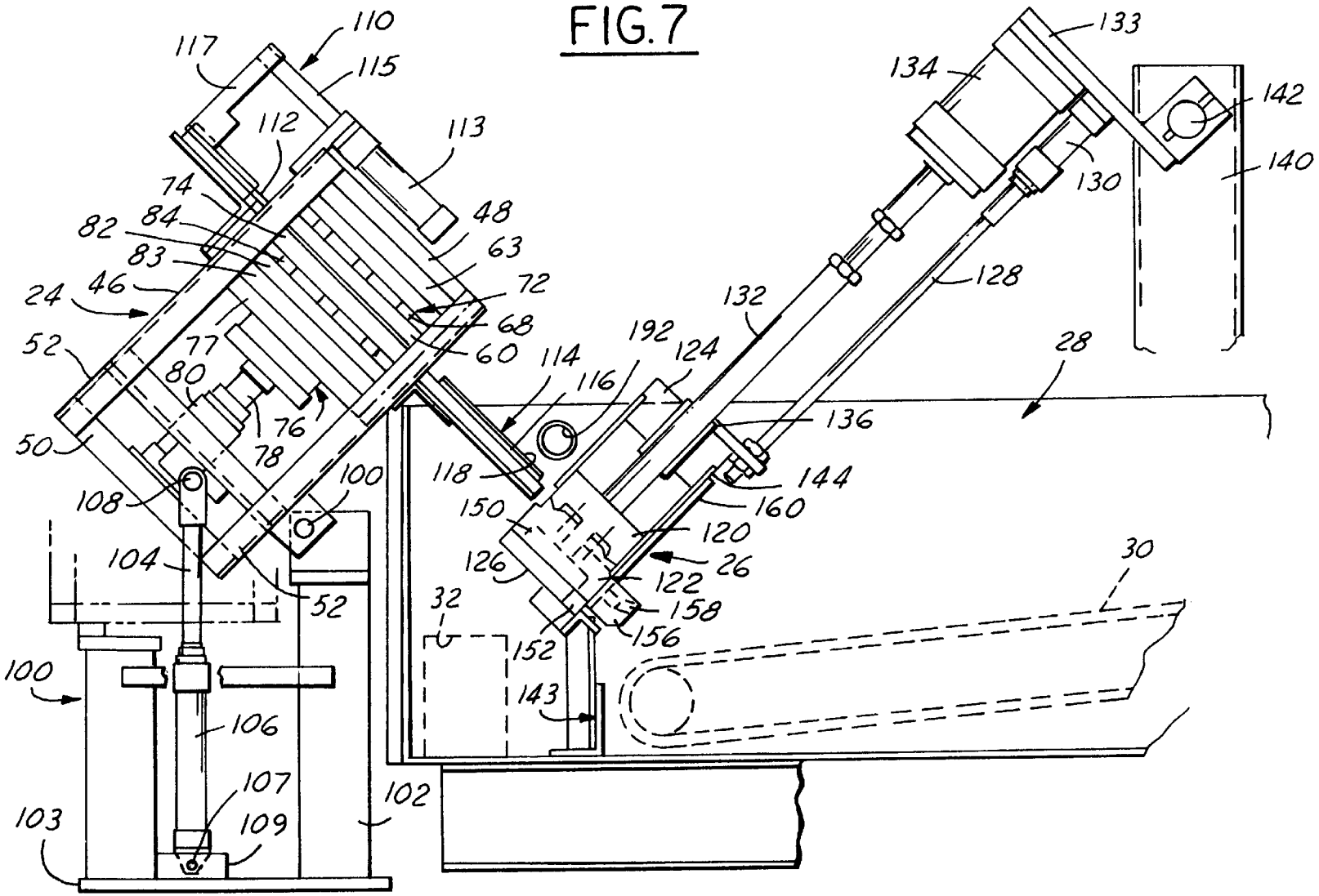
FIG. 7 is a cross sectional view illustrating the construction and arrangement of the second heater and the forming die.

As shown in FIG. 7, the second heater 24 is mounted in a stand 100 for for rotation about a pivot pin 100 fixed to an upright 102 itself fixed to a base plate 103 bearing on the floor. An actuating rod 104 of a power source, such as a hydraulic cylinder 106, is pivotally connected to the frame 46 of the second heater 24 by a pin 108 to drive the second heater 24 for rotation about its pivot 100. When the actuating rod 104 is in its extended position, the second heater 24 is canted or tilted, as shown in FIG. 7, to facilitate transferring a ring 12 in the second heater 24 to the forming die 26. As the actuating rod 104 is retracted, the second heater rotates generally counterclockwise about its pivot, as viewed in FIG. 7, to move the second heater 24 to a vertically upright position to facilitate receiving a ring 12 from the first heater 22. The other end of the cylinder 106 is attached by a pivot pin 107 and a bracket 109 to the base plate 103.

To facilitate transferring the ring 12 in the second heater 24 to the forming die 26, a pusher mechanism 110 is attached to the frame of the second heater 24 and has a thin pusher blade 112 constructed to be received between the upper and lower copper platens 60, 74 of the second heater 24 when the ram 76 of the second heater 24 is in its retracted position. The pusher blade 112 is actuated by a cylinder 113 through a rod 115 and a connector arm 117 and preferably extends only a short distance between the platens 60, 74 to initially start the ring 12 sliding out of the second heater 24 towards the forming die 26. Due to the inclined position of the second heater 24 when the ring 12 is being transferred to the forming die 26, the ring 12 may begin to slide out of the heater 24 when the ram 76 of the second heater 24 is retracted without the need for the pusher arm 112 to start the ring 12 moving.

Figure 8:
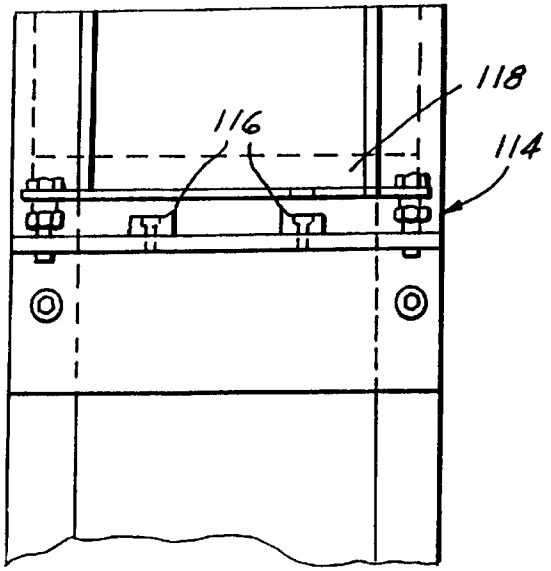
FIG. 8 is a side view of a slide attached to the second heater.

A slide 114 opposite the pusher 110 is attached to the side of the heater 24 and extends into the salt bath 28 adjacent to the forming die 26 when the second heater 24 is in its canted position. As best shown in FIG. 8, the slide 114 has a pair of thin rails 116 on which the ring 12 slides from the second heater 24 to the forming die 26 and preferably an insulated cover 118 extending over at least a major portion of the slide 114 to reduce the heat loss from the ring 12 as it is transferred into the forming die 26. The thin rails 116 engage a very limited surface area of the ring 12 to also reduce the heat loss from the ring 12 as it is transferred to the forming die 26.

Forming Dies

The forming die 26, as best shown in FIGS. 7 and 9–11, preferably has upper and lower halves 120, 122, respectively, each preferably submerged in the molten salt bath 28 throughout the operation of the system and apparatus 10. The upper and lower halves 120, 122 of the forming die 26 are received in a frame comprising upper and lower plates 124, 126 interconnected by one or more guides or rails (not shown). The upper plate 124 is preferably slidably received on the rails and is driven for movement relative to the lower plate 126 between extended and retracted positions by an actuating rod 128 of a first hydraulic cylinder 130 attached to the upper plate 124. The lower die half 122 is preferably fixed to the lower plate 126. The upper die half 120 is operably connected to an actuating rod 132 of a second hydraulic cylinder 134 slidably received through a bearing 136 carried by the upper plate 124. The second hydraulic cylinder 134 drives the upper die half 120 between a retracted position spaced from the lower die half 122 and an extended position to form a ring 12 received between the upper and lower die halves 120, 122. Both hydraulic cylinders 130, 134 are attached to a carrier plate 138 which is pivotally connected to an upright 140 so that the hydraulic cylinders 130, 134 and the interconnected forming die 26 may be rotated about the pivot 142 to remove the forming die 26 from the salt bath 28 and facilitate service and replacement of the forming die halves 120, 122. A stand 143 in the salt bath 28 supports the lower end of forming die 26 when it is disposed in the salt bath 28 in use.

Figure 10:
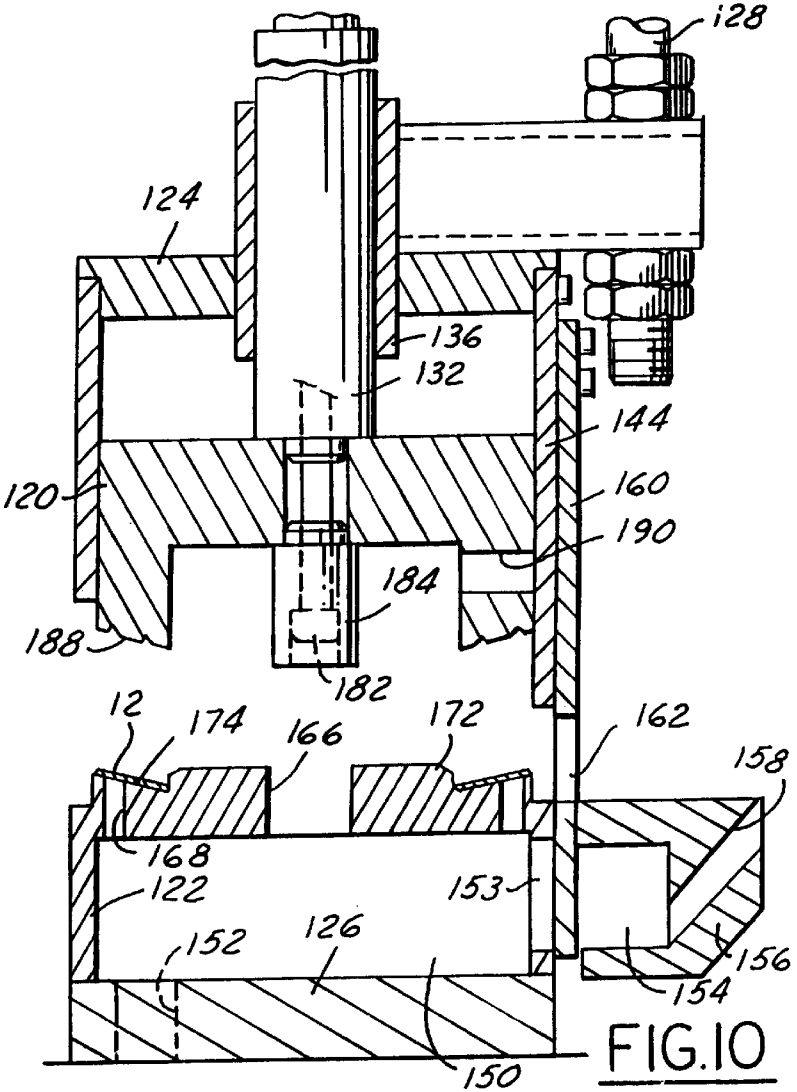
FIG. 10 is a cross sectional view of the forming die of FIG. 9 in an open position.
Figure 9:
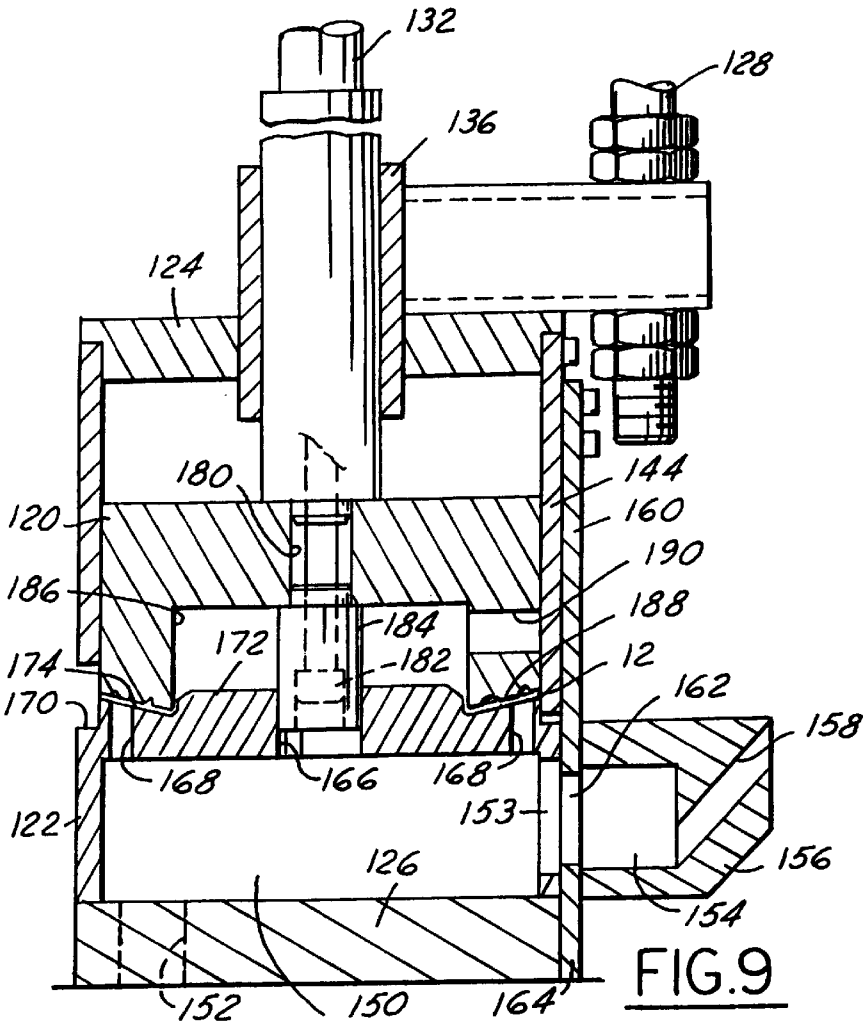
FIG. 9 is a cross sectional view of a forming die in a closed position.

As shown in FIGS. 9 and 10, the lower forming die half 122 has a central bore 166 and a plurality of circumferentially spaced holes 168 communicating with a cavity 150 defmed between the lower die half 122 and the lower plate 126. A groove 170 formed about the periphery of the lower forming die half 122 receives at least a portion of a cylindrical locating wall 144 fixed to the upper plate 124 which generally locates a ring 12 between the upper and lower halves 120, 122 of the forming die 26 when the forming die 26 is open. A raised circular mandrel portion 172 of the lower forming die half 122 pilots and locates the ring 12 on a generally beveled or frustoconical annular forming face 174 of the lower die half 122. Preferably, the circumferentially spaced holes 168 through the lower half of the forming die extend through the forming face 174 and thus communicate with a ring 12 received on the lower forming die half 122.

Figure 11:
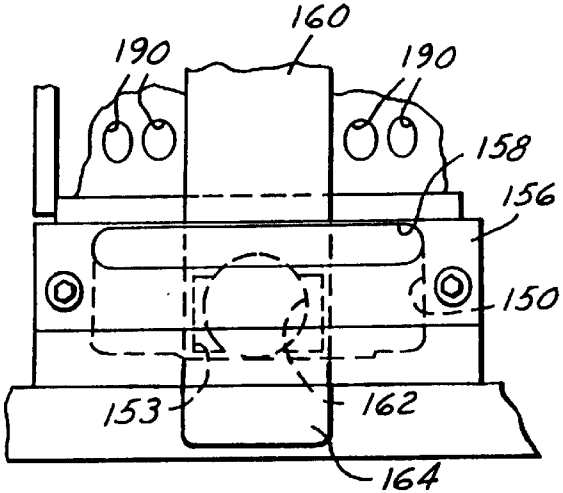
FIG. 11 is a side view of the forming die.

The upper forming die half 120 has a through bore 180 which receives a cap screw 182 which operably connects a locator 184 to the actuating rod 132 of the second hydraulic cylinder 134 and a counterbore 186 providing clearance from the mandrel portion 172 of the lower die half 122. As the upper die half moves to its extended position, the locator 184 is received in the bore 166 of the lower forming die half 122 to align them. The upper forming die half 120 has a generally beveled or frustoconical forming face 188 which is generally complementary shaped to the forming face 174 of the lower die half 122 and which is aligned therewith to form the flat rings 12 into their final generally frustoconical shape. One or more holes 190 through the upper forming die half 120 communicate with the molten salt bath 28, as best shown in FIGS. 9–11, to prevent any fluid from being trapped between the upper and lower forming die halves 120 and 122.

A generally semi-cylindrical or C-shaped ring locating wall 144 is connected to the upper plate 124 for movement therewith. When the upper plate 124 is in its retracted position the bottom of the ring locating wall 144 is spaced from the lower die half 122 to permit a formed ring 12 to pass between them. When the upper plate 124 is in its extended position, the ring locating wall 144 is positioned on or closely adjacent the lower die half 122 to prevent a ring 12 released from the second heater 24 from passing through the forming die 26 before it is formed.

The lower forming die half 122 defmes a cavity 150 with the lower plate 126 which communicates with the molten salt bath 28 through an inlet passage 152 through the lower plate 126. An opening 153 through the lower half 122 of the forming die communicates with a cavity 154 of a housing 156 attached to one or both of the lower die half 122 and the lower plate 126. A passage 158 through the housing 156 communicates the cavity 154 with the molten salt bath 28 generally adjacent the conveyor 30. A generally flat elongate slide gate 160 connected to the upper plate 124 for movement therewith has an opening 162 which aligns with the opening 153 and the cavity 154 in the housing 156 when the upper plate 124 is in its extended position. The slide gate 160 also has a lower portion 164 which substantially closes or blocks off the opening 153 in the lower half of the forming die 122 when the upper plate 124 is in its retracted position to substantially prevent the cavity 150 from communicating with the salt bath 28 through the passage 158.

To receive a ring 12 from the second heater 24, the upper die half 120 is moved to its retracted position and the upper plate 124 is moved to its extended position (towards the lower plate 126). This aligns the opening 162 of the gate 160 with the opening 153 to permit flow of molten salt through the cavity 150 to the molten salt bath 28 through the cavity 154 and passage 158 in the housing 156. With the upper plate 124 in its extended position, the bottom of the ring locating wall 144 is also positioned on or adjacent the lower forming die half 122 to prevent the heated flat ring 12 from passing through the open die 26 and to the conveyor 30 before it is formed.

As a ring 12 moves off of the slide 114 it is submerged in the salt bath 28 and received between the upper forming die half 120 (which is in its retracted position) and the lower forming die half 122 and is properly located on the lower forming die half 122 by the ring locating wall 144 and the mandrel portion 172 of the lower die half 122. Next, the second hydraulic cylinder 134 advances the upper die half 120 to its extended position bearing on and pressing and hot forming the flat, heated ring 12 between the forming faces 174, 188 of the upper and lower die halves 120, 122 to form the ring 12 into its desired generally frustoconical final shape. The forming die is held in this closed position (with the upper die half in its extended position) for a short duration, typically on the order of 20 to 40 seconds, to restrain the formed ring 12 within the die 26 until it is cooled sufficiently so that the formed ring 12, upon further cooling while not restrained in the forming die 26, will not warp or otherwise become significantly distorted from its desired final shape.

Upon sufficient cooling of the ring 12, the upper forming die half 120 is moved to its retracted position spaced from the ring 12 and the lower die half 122. The upper plate 124 is also moved to its retracted position separating the ring locating wall 144 from the lower die half 122 and moving the lower portion of the gate 160 between the cavity 153 and the housing 156 to substantially prevent fluid flow through the passage 158 from the cavity 150. With the passage 158 blocked off, the molten salt in the cavity 150 flows upwardly through the plurality of holes 168 through the lower die half 122 to dislodge the formed ring 12 from the lower die half 122 and onto the conveyor 30 which slowly carries the formed rings 12 away from the forming die 26. Preferably, one or more jets 192 (FIGS. 7 and 12) in the molten salt bath 28 and powered by the pump 32 therein create a flow in the proper direction over the conveyor 30 to insure that the rings 12 dislodged from the forming die 26 are carried onto the conveyor 30.

To increase the rate of production of formed rings 12, more than one forming die 26 may be disposed in the salt bath 28. Each forming die 26 may be simultaneously driven by the same hydraulic cylinders or they may be driven independently by separate cylinders. Preferably, each forming die has its own heaters 22, 24 and is independently driven by separate cylinders and may be simultaneously used to form different parts to increase the flexibility of the system and apparatus 10.

Salt Bath

Figure 13:
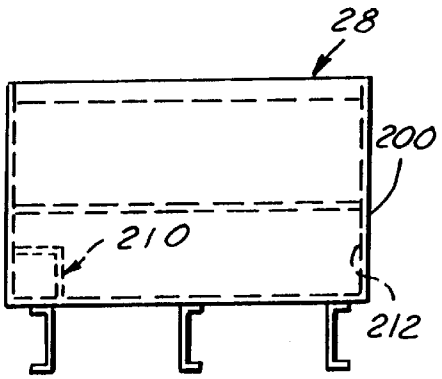
FIG. 13 is an end view of the salt bath.
Figure 12:
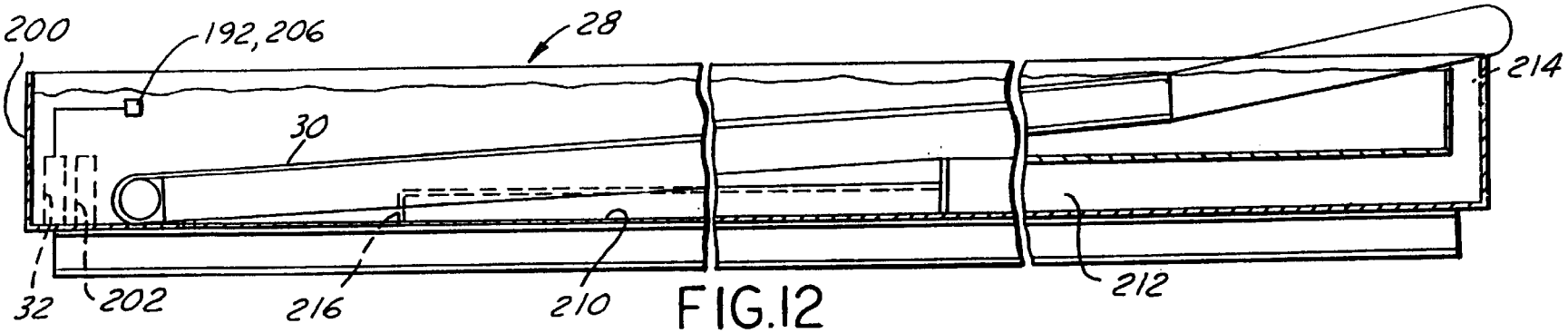
FIG. 12 is a broken side view of the salt bath.

As shown in FIGS. 7, 12 and 13, the salt bath has a tub 200 which holds the molten salt quenching medium, the recirculating pump 32 which continuously recirculates the quenching medium to maintain a more uniform temperature throughout the tub 200, a heater 202 which heats and maintains the quenching medium at a predetermined desired temperature usually about 600° F., and the conveyor 30 which moves formed rings away from the forming die 26 while maintaining the rings immersed in the quenching medium. Outlet pipes 204 from the pump 32 deliver a portion of the quenching medium under pressure through nozzles or jets 192, 206 adjacent the forming die 26 to ensure that when the formed rings are removed from the die 26 they are carried onto the conveyor 30. The conveyor 30 is preferably inclined such that the end of the conveyor 30 distal from the forming die 26 extends out of the salt bath 28 to carry the formed and heat treated parts out of the salt bath 28. The formed rings 12 remain submerged in the molten salt in the tub 200 along a substantial portion of the conveyor 30 to austemper them.

Preferably, a tube 210 connected to the inlet of the pump 32 extends along the bottom of the tub 200 and communicates with a generally hollow body 212 open at one end 214 at a predetermined height. The pump 32 creates a pressure drop at the open end 216 of the tube 210 which is communicated through the body 212 to its open end 214. The pressure drop at the open end 214 of the body 212 maintains the level of the molten salt solution in the tub 200 at or near the level or height of the open end 214 of the body 212. The body 212 provides a sort of "false bottom" of the tub 200 and while initially full of the salt solution, the body 212 becomes increasingly empty as some of the salt solution is carried out of the tub 200 with or on the rings 12 as they are removed from the salt bath 28. Preferably, the volume of the tube 210 and body 212 combined is about 50 gallons so that up to 50 gallons of salt solution may be removed from the tub 200 without lowering the level of salt solution in the tub 200. It is important to maintain a sufficiently high level of salt solution in the tub 200 so that the rings 12 remain submerged in the salt solution for a sufficient time as they travel on the inclined conveyor 30 to enable austempering of the formed rings.

Operation

A plurality of flat rings 12 are individually placed on each plate 14 of the indexing table 16 and then transferred one at a time to the preheating platen 20 by the pick and place mechanism 18. Each ring 12 is preheated by the preheating platen 20 until the pusher 44 transfers the preheated ring 12 into the first heater 22 to at least begin heating the ring to its desired final temperature. When a ring 12 is received within the first heater 22, the fluid cylinder 80 is actuated to move the heater ram 76 to its extended position to close and engage the flat ring 12 between the upper and lower copper platens 60, 74 as it is being heated. When it is desired to transfer the ring 12 to the second heater, the ram 76 is retracted and the flat ring 12 is transferred from the first heater 16 to the second heater 18 by pusher 96.

After the ring 12 is heated to its final temperature in the second heater 24, the hydraulic cylinder 106 is actuated to move its actuating rod 104 to its extended position thereby pivoting the second heater 24 about its pin 100 and into its canted position. The ram 76 of the second heater 24 is then retracted separating the upper and lower copper platens 60, 74 of the second heater 24 and the pusher blade 112 is inserted between the upper and lower copper platens 60, 74 to initially start the ring 12 moving onto the slide 114.

To receive a heated flat ring 12 into the forming die 26 from the slide 114, the upper die half 120 is positioned in its retracted position and the upper plate 124 is moved to its extended position to move the ring locating wall 144 onto or adjacent the lower die half 122. As the heated flat ring 12 moves off the end of the slide 114, it is immersed in the molten salt bath 28 and moves in between the open upper and lower die halves 120, 122. The ring locating wall 144 prevents the ring 12 from passing completely through the forming die 26 before it is formed. The ring locating wall 144 and the mandrel portion 172 of the lower die half 122 pilot and locate the ring 12 on the lower die half 122. Then the upper die half 120 is moved to its extended position to press the ring 12 between the upper and lower die halves 120, 122 and thereby hot form the ring 12 into its desired final shape while immersed in the molten salt in the salt bath 28 to quench and heat treat the formed ring 12. After a short period of time, typically between 25 to 35 seconds, the formed ring 12 is sufficiently cooled such that it may be released from the forming die 26 while remaining in the molten salt bath 28 for austempering to form bainite without significant deformation.

To release a formed ring 12 from the forming die 26, the upper die half 120 is moved to its retracted position spaced from the lower die half 122 and the upper plate 124 is moved to its retracted position wherein the lower portion 164 of the gate 160 prevents fluid flow from the cavity 150 to the passage 158. The circulating molten salt in the salt bath 28 flows through the inlet passage 152 of the lower plate 126 and into the cavity 150 and thereafter through the circumferentially spaced holes 168 in the lower die half 122 to dislodge the formed ring 12 from the lower die half 122. With the upper plate 124 in its retracted position, the locator wall 144 is retracted from the lower die half 122 and thus, the formed ring 12 is carried out of the forming die 26 and onto the conveyor 30 by the flow of the molten salt solution in the salt bath 28. The formed ring 12 remains on the conveyor 30 and submerged within the molten salt bath 28 for an extended period of time, typically on the order of 25 to 35 minutes. Preferably, the conveyor 30 is inclined at a slight angle such that when the formed rings 12 reach the downstream end of the conveyor 30, they are carried out of the molten salt solution and removed from the salt bath 28. Thus, in normal operation, there is a plurality of formed quenched rings 12 in the molten salt bath 28 at any given time.

Heating the rings 12 to the elevated temperature and then quenching them within the salt bath 28 forms austenite which is hard but relatively brittle. Maintaining the rings 12 within the salt bath 28 for the extended period of time transforms the austenite to bainite which has improved flexure and tensile strength and dramatically improved impact resistance compared to austenite while maintaining a sufficiently hard ring 12.

The improved forming and heat treating process and apparatus of this invention has a high production rate and can be substantially automated to form two or more rings simultaneously. By hot forming the flat rings 12 and restraining the formed rings within the forming die 26 until they are sufficiently cooled in the molten salt bath 28, warping and deformation of the formed rings due to die stamping and the rapid cooling is drastically reduced if not completely eliminated. Further, the rapid quenching of the rings 12 frees up the forming die 26 so that subsequent flat rings can be formed and quenched while previously formed rings remain in the molten salt bath 28 and are austempered to form the desirable bainite and physical properties.

I claim:

1. An apparatus to form and heat treat metallic parts comprising:

at least one heater constructed to heat metallic parts to between a temperature of 1400° to 1800° F.;

a quenching bath containing a quenching liquid medium maintained at a temperature between about 500° F. to 800° F.; and at least one forming die to hot form a heated part and to restrain the formed heated part constructed and arranged so that a hot part heated by the heater and while in the quenching liquid medium is hot formed in the forming die and continuously restrained in the forming die while continuing to be immersed in the quenching medium for at least about 20 seconds and until the part reaches a temperature wherein further cooling and tempering will not cause deformation of the formed part and then the formed part is removed from the forming die while continuing to be maintained within the quenching medium for an extended period of time of at least about 20 minutes sufficient to form bainite.

2. The apparatus of claim 1 wherein the forming die is normally at least partially submerged in the quenching medium so that the part is initially immersed in the quenching medium before it is formed in the forming die.

3. The apparatus of claim 1 which also comprises a preheater which initially heats the parts before they are loaded into the heater to reduce the time needed to heat the parts in the heater to the desired temperature.

4. The apparatus of claim 3 which also comprises an automatic loader which loads individual parts onto the preheater.

5. The apparatus of claim 4 wherein the automatic loader comprises an indexing table and a pick and place mechanism which transfers the parts from the indexing table to the preheater.

6. The apparatus of claim 1 wherein the formed parts are annular, relatively thin rings of steel with a generally tapered or frustoconical final shape.

7. The apparatus of claim 6 wherein the parts are generally flat before being formed in the forming die.

8. The apparatus of claim 1 wherein the quenching medium is a molten salt solution.

9. The apparatus of claim 1 wherein the formed part is maintained in the forming die while immersed in the quenching medium for about 20 to 40 seconds.

10. The apparatus of claim 1 wherein the formed part is maintained in the quenching bath for a total time of about 20 to 35 minutes.

11. The apparatus of claim 1 which also comprises a conveyor in the quenching bath and constructed to carry formed parts released from the forming die away from the forming die and maintain them submerged in the quenching bath.

12. The apparatus of claim 1 which also comprises a pump in the quenching bath which recirculates the quenching medium in the bath.

13. A method of heat treating and forming a metallic part comprising the steps of:

(a) providing a flat, metallic steel ring;

(b) heating the ring to a temperature in the range of about between 1400° F. to 1800° F.;

(c) placing the hot ring in a forming die and while immersed in a quenching liquid medium hot forming the ring into its final shape;

continuing to restrain the hot formed ring in the forming die for at least about 20 seconds while continuing to be immersed in the quenching liquid medium maintained at a temperature of at least 500° F. and significantly below the initial temperature of the hot formed ring; and (e) continuing to maintain the formed ring within the quenching medium for at least about 20 minutes to austemper the ring and form bainite.

14. The method of claim 13 wherein the quenching medium is at a temperature of about between 500° F. to 800° F.

15. The method of claim 13 wherein the quenching medium is a molten salt solution.

16. The method of claim 13 wherein step (e) comprises maintaining the formed ring within the quenching medium for about 20 to 35 minutes.

17. The method of claim 13 wherein step (d) comprises maintaining the formed ring in the forming die for about between 20 to 40 seconds while immersed in the quenching medium and then the formed ring is released and removed from the forming die while immersed in the quenching medium and maintained in the quenching medium to form bainite.

* * * * *